US010077489B2

(12) United States Patent
Kobayashi et al.

(10) Patent No.: US 10,077,489 B2
(45) Date of Patent: Sep. 18, 2018

(54) STEEL SHEET FOR SOFT-NITRIDING AND METHOD FOR MANUFACTURING THE SAME

(75) Inventors: Takashi Kobayashi, Kawasaki (JP); Nobuyuki Nakamura, Fukuyama (JP); Tetsuya Mega, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 473 days.

(21) Appl. No.: 14/408,662

(22) PCT Filed: Jun. 27, 2012

(86) PCT No.: PCT/JP2012/067022

§ 371 (c)(1),
(2), (4) Date: Jun. 29, 2015

(87) PCT Pub. No.: WO2014/002287

PCT Pub. Date: Jan. 3, 2014

(65) Prior Publication Data

US 2015/0299830 A1 Oct. 22, 2015

(51) Int. Cl.

| | |
|---|---|
| ***C22C 38/26*** | (2006.01) |
| ***C22C 38/00*** | (2006.01) |
| ***C21D 9/46*** | (2006.01) |
| ***C23C 8/32*** | (2006.01) |
| ***C22C 38/02*** | (2006.01) |
| ***C22C 38/04*** | (2006.01) |
| ***C22C 38/06*** | (2006.01) |
| ***C21D 6/00*** | (2006.01) |
| ***C21D 8/02*** | (2006.01) |

(52) U.S. Cl.

CPC ..... *C22C 38/26* (2013.01); *C21D 6/002* (2013.01); *C21D 6/005* (2013.01); *C21D 6/008* (2013.01); *C21D 8/0263* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C23C 8/32* (2013.01); *C21D 2211/005* (2013.01); *C21D 2211/009* (2013.01)

(58) Field of Classification Search

CPC ..... C22C 38/54; C22C 38/50; C22C 38/48; C22C 38/46; C22C 38/44; C22C 38/06; C22C 38/04; C22C 38/02; C22C 38/002; C22C 38/001; C21D 8/0221; C21D 8/0263; C21D 6/004; C21D 6/005; C21D 6/008

See application file for complete search history.

(56) References Cited

U.S. PATENT DOCUMENTS 5,454,883 A * 10/1995 Yoshie ..... C21D 1/18 148/320
5,858,130 A * 1/1999 Bodnar ..... C22C 38/14 148/332
2007/0193666 A1* 8/2007 Asahi ..... B32B 15/01 148/654
2013/0032253 A1 2/2013 Kariya et al.
2013/0133790 A1* 5/2013 Ariga ..... C21D 8/0226 148/602
2013/0273393 A1* 10/2013 Imataka ..... C21D 7/02 428/684

FOREIGN PATENT DOCUMENTS

| | | |
|---|---|---|
| CN | 1322256 | 11/2001 |
| CN | 101765673 | 6/2010 |
| CN | 102119236 | 7/2011 |
| EP | 1170390 | 1/2002 |
| EP | 2397570 | 12/2011 |
| JP | S61284554 | 12/1986 |
| JP | S63145754 | 6/1988 |
| JP | H05171347 | 7/1993 |
| JP | 9025513 | 1/1997 |
| JP | 9025543 | 1/1997 |
| JP | H09143570 A | 6/1997 |
| JP | 2001316759 | 11/2001 |
| JP | 2003105489 | 4/2003 |
| JP | 2003277887 | 10/2003 |
| JP | 2005171331 | 6/2005 |
| JP | 2005264205 | 9/2005 |
| JP | 2005264205 A * | 9/2005 |
| JP | 2006336065 | 12/2006 |
| JP | 2007031771 | 2/2007 |

(Continued)

OTHER PUBLICATIONS

English machine translation of JP 2005-264205.*
Korean Office Action dated Apr. 5, 2016 for Korean Application No. 2015-7000900 with Concise Statement of Relevance.
European Search Report dated Mar. 3, 2016 for European Application No. 12880107.3-1373.
International Search Report for International Application No. PCT/JP2012/067022 dated Sep. 4, 2012.

(Continued)

*Primary Examiner* — Veronica F Faison
(74) *Attorney, Agent, or Firm* — RatnerPrestia

(57) ABSTRACT

A steel sheet for soft-nitriding has a composition containing: C: 0.05% or more to 0.10% or less; Si: 0.5% or less; Mn: 0.7% or more to 1.5% or less; P: 0.05% or less; S: 0.01% or less; Al: 0.01% or more to 0.06% or less; Cr: 0.5% or more to 1.5% or less; Nb: 0.005% or more to 0.025% or less; and N: 0.005% or less, on a mass percent basis, such that C and Nb satisfy $0.10 \leq Nb/C \leq 0.30$ (where C and Nb are respective contents of the elements (by mass %)), wherein balance comprises Fe and incidental impurities, and a microstructure that is a complex-phase microstructure containing ferrite and pearlite, and the microstructure having a ratio of a microstructure other than the ferrite and the pearlite of 1% or less, and the microstructure having a ratio of polygonal ferrite in the ferrite of less than 50%.

2 Claims, No Drawings

(56) References Cited

FOREIGN PATENT DOCUMENTS

| | | | | |
|---|---|---|---|---|
| JP | 2008280598 | | 11/2008 | |
| JP | 2008297570 | | 12/2008 | |
| JP | 2009068057 | | 4/2009 | |
| JP | 2009185355 | | 8/2009 | |
| JP | 2010024547 | | 2/2010 | |
| WO | 2011132763 | A1 | 10/2011 | |
| WO | WO-2011122031 | A1 * | 10/2011 | ..... C21D 8/0226 |
| WO | 2012053541 | | 4/2012 | |

OTHER PUBLICATIONS

Chinese Office Action for Chinese Application No. 201280074345.0, dated Aug. 31, 2016, including Concise Statement of Search Report, 8 pages.

Final Office Action for U.S. Appl. No. 14/781,440, dated Apr. 24, 2018, 14 pages.

U.S. Non-Final Office Action for U.S. Appl. No. 14/781,440, dated Oct. 18, 2017, 18 pages.

* cited by examiner

STEEL SHEET FOR SOFT-NITRIDING AND METHOD FOR MANUFACTURING THE SAME

CROSS REFERENCE TO RELATED APPLICATIONS

This is the U.S. National Phase application of PCT/JP2012/067022, filed Jun. 27, 2012, the disclosure of this application being incorporated herein by reference in its entirety for all purposes.

FIELD OF THE INVENTION

The present invention relates to a steel sheet for soft-nitriding (nitrocarburizing) suitable for mechanical structure components including transmission components for automobile and the like, where fatigue strength and wear resistance are required. In particular, the present invention relates to a steel sheet for soft-nitriding and a method for manufacturing the steel sheet for soft-nitriding excellent in formability before soft-nitriding and strength stability after the soft-nitriding.

BACKGROUND OF THE INVENTION

For mechanical structure components including transmission components for automobile and the like, which are used under stress continuously for a long time, fatigue strength and wear resistance are required. Accordingly, these mechanical structure components are usually manufactured by surface hardening heat treatment processing a steel material to a desired component shape followed by surface hardening heat treatment. As a steel surface becomes hard and compressive residual stress is introduced to a steel surface layer portion by performing the surface hardening heat treatment, the fatigue strength and the wear resistance of the component are improved.

Carburizing and nitriding are shown as the typical surface hardening heat treatment. The carburizing heats a steel to a temperature of an $A_3$ transformation point or more so that carbon diffuses and penetrates (carburize) at the surface layer portion of the steel. Usually, a high-temperature steel after carburizing is directly quenched to achieve surface hardening of the steel. In this carburizing, since the carbon is diffused and penetrated at the steel surface layer portion in a high-temperature range of the $A_3$ transformation point or more, the carbon diffuses and penetrates from the steel surface to a comparatively deep position. This allows obtaining a large hardened layer depth.

However, in the case where the carburizing is selected as the surface hardening heat treatment, deterioration in accuracy of component shape caused by transformation strain and heat strain during the quenching cannot be avoided. In a state where the steel remains to be as-quenched after the carburizing, toughness of the steel is considerably deteriorated. Accordingly, when manufacturing components through the carburizing, to achieve correction of a component shape and recovery of toughness, performing tempering (for example, press tempering treatment) is necessary after the quenching. This increases the number of manufacturing steps, extremely disadvantageous in terms of a production cost.

On the other hand, the nitriding heats a steel to a temperature of an $A_1$ transformation point or less to diffuse and penetrate (nitride) nitrogen at the steel surface layer portion. This ensures surface hardening of the steel without quenching like the carburizing. That is, since the nitriding features a comparatively low treatment temperature and does not involve a phase transformation of the steel, manufacturing the components through the nitriding allows maintaining good accuracy of component shape. However, gas nitriding using ammonia gas requires considerably long nitriding time, approximately 25 to 150 hours, and therefore is not suitable to automotive parts and the like supposed to be mass produced.

Soft-nitriding has been recently popular as treatment for advantageously solving the problem observed in the gas nitriding. The soft-nitriding is nitriding to quickly progress a nitriding reaction using carburizing atmosphere. Although obtained steel surface hardness is lower than the conventional nitriding (gas nitriding), this soft-nitriding allows significant shortening of the nitriding time.

The soft-nitriding is broadly classified into a method of nitriding in salt bath and a method of nitriding in gas. The method of nitriding in salt bath (salt bath soft-nitriding) uses a cyanogen-based bath; therefore, measures to prevent environmental pollution is necessary. On the other hand, since the method of nitriding in gas (gas soft-nitriding) uses mixed gas with the main component of ammonia, this method emits less discharge causing the environmental pollution. Due to the above-described reasons, an adoption ratio of the gas soft-nitriding, which nitrides a steel in gas, has been particularly increased among the soft-nitriding.

On the other hand, conventionally, mechanical structure components such as transmission components for automobile are generally manufactured by machining an intermediate product obtained by casting and forging and then processing and joining the intermediate product to a desired shape. However, recently, steel sheets (thin steel sheets) have been actively used as a raw material. Performing press processing or the like on the steel sheet (thin steel sheet) shapes the steel sheet into a desired shape, thus manufacturing the component. This shortens the manufacturing processes than the conventional manufacturing processes, allowing significant reduction of the production cost. From this background, demands on the steel sheet for soft-nitriding excellent in formability, which is suitable as a material of the mechanical structure component including the transmission component for automobile or the like, have been increased, and accordingly, various techniques have been proposed up to the present.

For example, Patent Literature 1 and Patent Literature 2 disclose a method for manufacturing steel sheet for nitriding excellent in formability and the steel sheet for nitriding excellent in formability having a composition described below. A steel has a chemical composition containing, by weight ratio, C: 0.01 to less than 0.08%, Si: 0.005 to 1.00%, Mn: 0.010 to 3.00%, P: 0.001 to 0.150%, N: 0.0002 to 0.0100%, Cr: more than 0.15 to 5.00%, Al: more than 0.060 to 2.00%, and further containing one or two of Ti: 0.010% or more to less than 4C [%], and V: 0.010 to 1.00%. The steel is coiled at 500° C. or more after hot rolling, or is further cold-rolled at a rolling reduction of 50% or more after the coiling followed by recrystallization annealing. According to this technique, by controlling a C content, which adversely affects the formability, to less than 0.08% and by containing Cr, Al, or the like as a nitriding promoting element, it is described that steel sheet for nitriding excellent in formability and nitridation is obtained.

Patent Literature 3 proposes the following steel for soft-nitriding. The steel for soft-nitriding has a chemical composition containing, by mass %: C: 0.03% or more to less than 0.10%, Si: 0.005 to 0.10%, Mn: 0.1 to 1.0%, and Cr:

0.20 to 2.00% and as impurities, S: 0.01% or less, P: 0.020% or less, sol. Al: 0.10% or less, and N: 0.01% or less and the balance comprising Fe. The steel for soft-nitriding has a ferrite grain size of grain size number 5 or more to 12 or less specified by JIS G 0552. According to the technique, it is descried that since expensive element of Ti, V, or the like is not added, an inexpensive steel sheet can be obtained. Moreover, it is descried that refining a crystal grain diameter of the steel allows obtaining a steel sheet excellent in press processability.

Patent Literature 4 proposes the following thin steel sheet for nitriding. The thin steel sheet for nitriding has a chemical composition containing, by mass %: C: more than 0.01% to 0.09% or less, Si: 0.005 to 0.5%, Mn: 0.01 to 3.0%, Al: 0.005 to 2.0%, Cr: 0.50 to 4.0%, P: 0.10% or less, S: 0.01% or less, and N: 0.010% or less. Optionally, the thin steel sheet for nitriding further contains one or two or more selected from V: 0.01 to 1.0%, Ti: 0.01 to 1.0%, and Nb: 0.01 to 1.0%. A grain boundary area Sv per unit volume is set at 80 $mm^{-1}$ or more to 1300 $mm^{-1}$ or less. According to the technique, by containing a nitride forming element, Cr, Al, V, Ti, Nb, or the like in a range of not inhibiting the formability of the steel sheet as well as regulating the grain boundary area per unit volume in a predetermined range, it is described that both high surface hardness and sufficient hardening depth can be obtained after nitriding.

Patent Literature 5 proposes a steel sheet for soft-nitriding having a composition containing: C: 0.03 to 0.10 mass %, Si: 0.5 mass % or less, Mn: 0.1 to 0.6 mass %, P: 0.04 mass % or less, S: 0.04 mass % or less, Al: 0.005 to 0.08 mass %, Cr: 0.4 to 1.2 mass %, Nb: 0.002 mass % or more to less than 0.01 mass %, and N: 0.01 mass % or less. According to the technique, it is described that containing a trace of Nb allows obtaining a steel sheet for soft-nitriding featuring both processability and fatigue property.

Patent Literature 1: Japanese Unexamined Patent Application Publication No. 9-25513

Patent Literature 2: Japanese Unexamined Patent Application Publication No. 9-25543

Patent Literature 3: Japanese Unexamined Patent Application Publication No. 2003-105489

Patent Literature 4: Japanese Unexamined Patent Application Publication No. 2003-277887

Patent Literature 5: Japanese Unexamined Patent Application Publication No. 2009-68057

SUMMARY OF THE INVENTION

However, the techniques proposed in Patent Literature 1 and Patent Literature 2 contain a large amount of Al as the nitriding promoting element. Therefore, an internal defect and a surface defect caused by an Al inclusion are apprehended. Since a considerable amount of Al based slug is generated during refining, a problem of rising smelting cost is also observed.

The technique proposed in Patent Literature 3 does not contain expensive elements, allowing obtaining inexpensive steel sheet for soft-nitriding. However, strength (tensile strength) of the steel sheet for soft-nitriding is around 420 MPa at the highest. This restricts an application to components used under high stress.

The technique proposed in Patent Literature 4 succeeds obtaining the thin steel sheet for nitriding with tensile strength exceeding 500 MPa; however, the technique does not consider hardness distribution in a sheet thickness direction after the nitriding. Therefore, with the technique, durability performance of components on which the nitriding is actually performed often fails to reach a necessary or sufficient level.

The technique proposed in Patent Literature 5 succeeds obtaining the steel sheet for soft-nitriding excellent in processability; however, strength (tensile strength) of the steel sheet for soft-nitriding is around 400 MPa at the highest. Accordingly, similar to the technique proposed in Patent Literature 3, this restricts an application to components used under high stress.

Further, when soft-nitriding the steel sheet, the steel sheet is usually heated to a treatment temperature of about 550 to 600° C. and then is held at the treatment temperature for about one to five hours. This considerably increases hardness of the steel sheet surface layer portion while the strength of the internal portion of steel sheet (non-nitrided portion) may be deteriorated, though. Therefore, even if the steel sheet has a desired strength (tensile strength) before the soft-nitriding, the soft-nitriding possibly tremendously deteriorates the strength of the internal portion of steel sheet (non-nitrided portion), failing to provide desired strength (fatigue strength) to the components after soft-nitriding.

Due to the above-described reasons, the following is one important characteristics for the steel sheet for soft-nitriding. The strength of the internal portion of steel sheet (non-nitrided portion) of the steel sheet for soft-nitriding is not tremendously deteriorated through the soft-nitriding. Further, a change in the strength of the internal portion of steel sheet (non-nitrided portion) between before and after the soft-nitriding is small; that is, the steel sheet for soft-nitriding has strength stability after the soft-nitriding. However, the all above-described conventional techniques do not examine the strength stability after the soft-nitriding at all.

The present invention advantageously solves the problems with the conventional techniques described above, and an object of the present invention is to provide a steel sheet for soft-nitriding featuring desired strength (tensile strength: 440 MPa or more) and excellent formability before soft-nitriding and strength stability after soft-nitriding and a method for manufacturing the steel sheet for soft-nitriding.

Intensive research was carried out by the inventors of the present invention on various factors affecting strength and formability of a steel sheet for soft-nitriding and a change in strength of an internal portion of steel sheet (non-nitrided portion) observed before and after the soft-nitriding in order to solve the above problems. As a result, the following findings were obtained.

1) Producing a steel sheet microstructure by a complex-phase microstructure that includes ferrite and pearlite allows reducing deterioration of strength of a steel sheet after soft-nitriding, ensuring obtaining the steel sheet featuring excellent strength stability.

2) If a ratio of polygonal ferrite occupying the ferrite increases, steel sheet strength is deteriorated. Moreover, the change in strength of the internal portion of steel sheet (non-nitrided portion) between before and after the soft-nitriding is likely to be large.

3) Regarding a steel sheet composition, containing a desired amount of Nb is effective to increase the steel sheet strength and to reduce the ratio of the polygonal ferrite occupying the ferrite.

4) Regarding the steel sheet composition, Nb and C are contained so as to satisfy a predetermined relationship ($0.10 \leq Nb/C \leq 0.30$). This decreases the change in the strength of the internal portion of steel sheet (non-nitrided portion) between before and after the soft-nitriding.

The present invention was completed based on the above-described findings, and the following aspects are included in the present invention. (1) A steel sheet for soft-nitriding has a chemical composition containing: C: 0.05% or more to 0.10% or less; Si: 0.5% or less; Mn: 0.7% or more to 1.5% or less; P: 0.05% or less; S: 0.01% or less; Al: 0.01% or more to 0.06% or less; Cr: 0.5% or more to 1.5% or less; Nb: 0.005% or more to 0.025% or less; and N: 0.005% or less, on a mass percent basis, such that C and Nb satisfy the following formula (1), wherein balance comprises Fe and incidental impurities, and a microstructure that is a complex-phase microstructure containing ferrite and pearlite, the microstructure having a ratio of a microstructure other than the ferrite and the pearlite of 1% or less, the microstructure having a ratio of polygonal ferrite in the ferrite of less than 50%.

$$0.10 \leq Nb/C \leq 0.30 \quad (1)$$

(where C and Nb are respective contents of the elements (by mass %))

(2) A method for manufacturing a steel sheet for soft-nitriding includes: heating a steel slab; performing hot rolling that includes rough rolling and finish rolling; and after the finish rolling, cooling and coiling the steel sheet to produce a hot-rolled steel sheet, wherein the steel slab has a chemical composition containing: C: 0.05% or more to 0.10% or less; Si: 0.5% or less; Mn: 0.7% or more to 1.5% or less; P: 0.05% or less; S: 0.01% or less; Al: 0.01% or more to 0.06% or less; Cr: 0.5% or more to 1.5% or less; Nb: 0.005% or more to 0.025% or less; and N: 0.005% or less, on amass percent basis, such that C and Nb satisfy the following formula (1), wherein balance comprises Fe and incidental impurities, and setting a heating temperature of the hot rolling from 1100° C. or more to 1300° C. or less, setting a finishing temperature of the finish rolling from an $Ar_3$ transformation point or more to ($Ar_3$ transformation point+100° C.) or less, setting an average cooling rate of the cooling to 30° C./s or more, and setting a coiling temperature of the coiling from 500° C. or more to 650° C. or less.

$$0.10 \leq Nb/C \leq 0.30 \quad (1)$$

(where C and Nb are respective contents of the elements (by mass %))

The present invention can provide a steel sheet for soft-nitriding that has a desired strength (tensile strength: 440 MPa or more) and excellent formability before soft-nitriding and strength stability after soft-nitriding. Accordingly, even for components used under high stress including transmission components for automobile and the like, the use of a steel sheet material allows greatly reducing a production cost, providing industrially useful effects.

DETAILED DESCRIPTION OF EMBODIMENTS OF THE INVENTION

The present invention will be described in detail with reference to exemplary embodiments. Firstly, reasons why the chemical compositions of a steel sheet according to the present invention are preferred will be described. Hereinafter, "%" used for the chemical composition indicates "mass %", unless otherwise stated.

C: 0.05% or more to 0.10% or less

C is an element that contributes to strengthening of steels through solid solution strengthening and formation of a second phase. If a C content is less than 0.05%, steel sheet strength required for a material of a component used under high stress including a transmission component for automobile and the like, cannot be ensured. Meanwhile, if the C content exceeds 0.10%, the steel sheet strength excessively increases, deteriorating formability. Accordingly, the C content is set to be 0.05% or more to 0.10% or less, preferably, 0.05% or more to 0.08% or less.

Si: 0.5% or less

Si is a solid-solution strengthening element. Si is an element effective for strengthening of the steel and also acts as a deoxidizer. To obtain this effect, containing Si of 0.03% or more is preferred. However, if the Si content exceeds 0.5%, a hard-to-remove scale is generated, remarkably deteriorating a surface appearance quality of the steel sheet. Accordingly, the Si content is set to be 0.5% or less, preferably, 0.1% or less.

Mn: 0.7% or more to 1.5% or less

Mn is a solid-solution strengthening element, and is an element effective for strengthening of the steel. Mn also fixes S present in a steel as impurities, as a precipitate, and acts as an element reducing a negative effect caused by S to the steel. If the Mn content is less than 0.7%, desired steel sheet strength cannot be ensured. Meanwhile, if the Mn content exceeds 1.5%, the steel sheet strength excessively increases, deteriorating formability. Accordingly, the Mn content is set to be 0.7% or more to 1.5% or less, preferably, 1.0% or more to 1.5% or less, more preferably, 1.2% or more to 1.5% or less.

P: 0.05% or less

P is an element that deteriorates the formability and toughness of the steel sheet, and is preferred to be reduced as much as possible in the present invention. Accordingly, the P content is set to be 0.05% or less, preferably, 0.03% or less.

S: 0.01% or less

S is an element that deteriorates the formability and toughness of the steel sheet similar to P, and is preferred to be reduced as much as possible in the present invention. Accordingly, the S content is set to be 0.01% or less, preferably, 0.005% or less.

Al: 0.01% or more to 0.06% or less

Al is an element acting as a deoxidizer. To reliably obtain this effect, the Al content is set to be 0.01% or more. Meanwhile, if the Al content exceeds 0.06%, deoxidation effect is saturated and an Al-based inclusion is increased, causing an internal defect and a surface defect of the steel sheet. Accordingly, the Al content is set to be 0.01% or more to 0.06% or less, preferably, 0.02% or more to 0.05% or less.

Cr: 0.5% or more to 1.5% or less

Cr is an element that forms a nitride in a steel by soft-nitriding, and is an element that has an effect of enhancing hardness of the steel sheet surface layer portion. Therefore, Cr is one of the important elements in the present invention. To make the effect remarkable, the Cr content is preferably 0.5% or more. Meanwhile, if the Cr content exceeds 1.5%, embrittlement of a surface hardened layer (nitrided layer) formed by the soft-nitriding becomes severe. Accordingly, the Cr content is set to be 0.5% or more to 1.5% or less, preferably, 0.8% or more to 1.2% or less.

Nb: 0.005% or more to 0.025% or less

Nb is precipitated as carbonitride (including carbide and nitride) in a steel and enhances the strength of steel sheet by particle dispersion strengthening (precipitation strengthening). Nb is also an effective element to ensure the strength stability of steel sheet after the soft-nitriding. Therefore, Nb is one of the important elements in the present invention. If the Nb content is less than 0.005%, desired steel sheet strength and the strength stability of steel sheet cannot be ensured. Meanwhile, if the Nb content exceeds 0.025%, the steel sheet strength excessively increases, deteriorating formability. Accordingly, the Nb content is set to be 0.005% or more to 0.025% or less, preferably, 0.010% or more to 0.020% or less.

N: 0.005% or less

N is a harmful element that deteriorates the formability of steel sheet. N is also an element that combines, before the soft-nitriding, with a nitriding promoting element including Cr or the like, and causes a reduction of an amount of effective nitriding promoting element. Accordingly, with the present invention, the N content is preferred to be reduced as much as possible and is set to be 0.005% or less, preferably, 0.003% or less.

Further, the steel sheet contains C and Nb in the above-described ranges and so as to satisfy the formula (1).

$$0.10 \leq Nb/C \leq 0.30 \quad (1)$$

(where C and Nb are respective contents of the elements (by mass %))

The above-described formula (1) is a condition to be satisfied for enhancing the steel sheet strength before soft-nitriding and for decreasing the change in strength of the internal portion of steel sheet (non-nitrided portion) between before and after the soft-nitriding, that is, for ensuing the strength stability after the soft-nitriding.

As described above, with the present invention, precipitation strengthening with Nb carbonitride is preferably used as one of a high strengthening mechanism of the steel sheet. Therefore, to reduce the change in strength of the internal portion of steel sheet (non-nitrided portion) caused by the soft-nitriding, reducing a variation of an amount of precipitation strengthening between before and after the soft-nitriding is important. To reduce the variation of the amount of precipitation strengthening, it is required that a precipitation state of the Nb carbonitride in the steel sheet (grain diameter and volume fraction) does not substantially vary from a precipitation state before the soft-nitriding even if the steel sheet experienced thermal history of the soft-nitriding.

Through examinations on means to stabilize the amount of precipitation strengthening before and after the soft-nitriding by the inventors, it was perceived that adjusting the Nb content with respect to the C content in the steel so as to satisfy the formula (1) is effective. This is probably due to the following reason. In the case where Nb/C is within the range of the formula (1), growth of the Nb carbonitride and additional precipitation during the soft-nitriding are suppressed, or the growth and precipitation is a trace and the amounts of precipitation strengthening are balanced. Accordingly, in the present invention, C and Nb are preferably adjusted so as to satisfy $0.10 \leq Nb/C \leq 0.30$.

In the steel sheet of embodiments of the present invention, the components other than the components described above are Fe and incidental impurities. As incidental impurities, for example, by mass %, Cu: 0.05% or less, Ni: 0.05% or less, Mo: 0.05% or less, Co: 0.05% or less, Ti: 0.005% or less, V: 0.005% or less, Zr: 0.005% or less, Ca: 0.005% or less, Sn: 0.005% or less, O: 0.005% or less, B: 0.0005% or less, and the like are acceptable.

The following describes reasons for the preferred microstructure of the steel sheet of the present invention. The steel sheet of the present invention preferably has a microstructure which is a complex-phase microstructure that contains ferrite and pearlite, and wherein a ratio of polygonal ferrite to occupy in the ferrite is less than 50%.

Increasing the ratio of the ferrite occupying the steel sheet microstructure is effective to ensure the formability of steel sheet. However, if the steel sheet is produced into a ferrite single-phase microstructure, the steel strength becomes insufficient and an application range as a material of a mechanical structure component is narrowed, resulting in poor versatility. On the other hand, in the case where strengthening of the microstructure is achieved by generating a second phase in a microstructure mainly containing ferrite to ensure the steel sheet strength, if a hard low-temperature transformation phase formed of martensite, bainite, or the like is produced as a second phase, the thermal history during the soft-nitriding softens the low-temperature transformation phase. This significantly increases the change in the strength of the internal portion of steel sheet (non-nitrided portion) between before and after the soft-nitriding.

Therefore, with embodiments of the present invention, to reduce the change in the strength of the internal portion of steel sheet (non-nitrided portion) due to the thermal history during soft-nitriding, the microstructure of steel sheet is set to be a complex-phase microstructure that includes ferrite as a main phase and pearlite as a second phase. With the present invention, it is preferred that a ferrite fraction in the steel sheet microstructure be 80% or more to 95% or less and a pearlite fraction in the steel sheet microstructure be 5% or more to 20% or less. The steel sheet of the present invention is ideal to be a complex-phase microstructure consisting of ferrite and pearlite. However, even if another phase (microstructure) is inevitably generated, it is acceptable as long as the fraction in the steel sheet microstructure is 1% or less in total.

Polygonal ferrite is soft and its grains are likely to grow when heating. Accordingly, the steel sheet containing much polygonal ferrite is likely to be low steel sheet strength, also likely to deteriorate the strength of the internal portion of steel sheet (non-nitrided portion) caused by the grain growth during soft-nitriding. Therefore, in embodiments of the present invention, ferrite other than polygonal ferrite occupies 50% or more of the ferrite, and polygonal ferrite occupies less than 50% of the ferrite. In the present invention, the ferrite other than polygonal ferrite includes acicular ferrite, bainitic ferrite, or the like.

The following describes an embodiment of a method for manufacturing the steel sheet of the present invention. The present invention heats a steel slab with the above-described chemical composition and performs hot rolling including rough rolling and finish rolling. After completing the finish rolling, the steel sheet is cooled and coiled, thus producing a hot-rolled steel sheet. In this respect, setting a heating temperature of the slab to 1100° C. or more to 1300° C. or less, a finishing temperature to an $Ar_3$ transformation point or more to ($Ar_3$ transformation point+100° C.) or less, an average cooling rate for cooling to 30° C./s or more, and a coiling temperature to 500° C. or more to 650° C. or less are preferred.

In the present invention, the method for smelting the steel is not specifically limited and can use a known smelting method using a converter, an electric furnace, or the like. After the smelting, in consideration of a problem of segregation and the like, a steel slab (slab) is preferred to be obtained by a continuous casting method. However, the steel slab may be obtained by a known casting method of an ingot-making-blooming method, a thin slab continuous casting method, and the like. Further, as necessary, various preliminary treatment of molten iron, secondary refining, surface trimming of the steel slab, or the like may be performed.

Heating temperature of steel slab: 1100° C. or more to 1300° C. or less

The steel slab obtained as described above is subjected to rough rolling and finish rolling. In the present invention, Nb should ideally be fully dissolved again in the steel slab before the rough rolling. If the heating temperature of the steel slab is less than 1100° C., the Nb carbonitride cannot be sufficiently decomposed and therefore Nb cannot be dissolved again, failing to develop the desired effect obtained by containing Nb. On the other hand, if the heating temperature of the steel slab exceeds 1300° C., energy required for heating the steel slab is increased, which is disadvantageous in a viewpoint of cost. Accordingly, the heating temperature of the steel slab before the rough rolling is set to be 1100° C. or more to 1300° C. or less, preferably, 1150° C. or more to 1250° C. or less.

When heating the steel slab before rough rolling, the steel slab after casting may be cooled to a room temperature and then be heated, or the steel slab after casting and during cooling may be additionally heated or heat of the steel slab may be retained. Alternatively, in the case where the steel slab after casting holds a sufficient temperature and Nb is sufficiently dissolved in the steel, the steel slab may be directly rolled without heating. Here, rough rolling conditions need not to be specifically limited.

Finishing temperature: $Ar_3$ transformation point or more to ($Ar_3$ transformation point+100° C.) or less In the case where the finishing temperature is less than the $Ar_3$ transformation point, a ferrite microstructure elongated in a rolling direction and an unrecrystallized ferrite microstructure are formed. This deteriorates the formability of the steel sheet. Additionally, as in-plane anisotropy of mechanical properties of the steel sheet becomes strong, uniform shaping process becomes difficult. On the other hand, if the finishing temperature exceeds ($Ar_3$ transformation point+100° C.), the surface appearance quality of the steel sheet tends to worsen. Accordingly, the finishing temperature is set to be $Ar_3$ transformation point or more to ($Ar_3$ transformation point+100° C.) or less. Here, the finishing temperature means a steel sheet temperature at a final path exit-side in the finish rolling.

To ensure the finishing temperature, the steel sheet during rolling may be additionally heated using a heating apparatus such as a sheet bar heater, an edge heater. The $Ar_3$ transformation point of steel can be obtained by measuring thermal shrinkage in a cooling process from an austenite temperature range and creating a thermal shrinkage curve. Alternatively, the $Ar_3$ transformation point can also be obtained by approximation from a content of an alloying element.

Average cooling rate: 30° C./s or more

Ensuring appropriate average cooling rate is important to form the steel sheet to be a desired microstructure. In an embodiment of the present invention, after completing the finish rolling, cooling is immediately (within 1 s) started at the average cooling rate from the finishing temperature to the coiling temperature being 30° C./s or more. If this average cooling rate is less than 30° C./s, a large amount of polygonal ferrite, which is likely to be generated in a high-temperature range, is generated, and the steel sheet with the desired microstructure cannot be obtained. Additionally, the crystal grains may become excessively coarse, possibly deteriorating the strength and ductility of the steel sheet. Further, in the present invention, by precipitating the Nb carbonitride in the steel sheet, high strengthening of the steel sheet can be achieved. However, if the average cooling rate is less than 30° C./s, the Nb carbonitride may become coarse, possibly failing to obtain the desired steel sheet strength. Accordingly, the average cooling rate is set to be 30° C./s or more.

The upper limit of the average cooling rate is not especially specified. However, to avoid a shape defect of the steel sheet caused by strong water cooling, the average cooling rate is preferably set at 100° C./s or less. After the steel sheet is cooled until reaching the coiling temperature, forced cooling by pouring water or the like is not especially required, and the steel sheet be left to be cooled in the air until coiling.

Coiling temperature: 500° C. or more to 650° C. or less

Ensuring appropriate coiling temperature is important to form the steel sheet into a desired microstructure. If the coiling temperature is less than 500° C., the low-temperature transformation phase is generated, and the steel sheet hardens. This deteriorates the formability and also deteriorates the strength stability of steel sheet after the soft-nitriding. On the other hand, if the coiling temperature exceeds 650° C., the amount of polygonal ferrite increases, failing to obtain a desired steel sheet microstructure. Accordingly, the coiling temperature is set to be 500° C. or more to 650° C. or less, preferably, 550° C. or more to 650° C. or less.

An oxide scale is removed from the hot-rolled steel sheet obtained as described above by pickling, shot peening, or the like, and then the hot-rolled steel sheet is used as a steel sheet for soft-nitriding. Even if temper rolling targeted for shape correction and/or adjustment of surface roughness is performed, the effects of the present invention will not be damaged. The steel sheet for soft-nitriding of the present invention is applicable to any of gas soft-nitriding and salt bath soft nitriding.

Example

Steels having chemical compositions listed in Table 1 were smelted. Then, ingot casting and rolling of ingots were performed to produce steel slabs. These steel slabs were heated, and then rough-rolled, finish-rolled, cooled, and coiled to produce hot-rolled steel sheets with sheet thickness of 2.9 mm. The heating temperature of the steel slab, and the finishing temperature, the average cooling rate from the finishing temperature to the coiling temperature, and the coiling temperature of the above-described steel sheets were as listed in Table 2.

TABLE 1

| | Chemical composition (mass %) | | | | | | | | | | |
|---|---|---|---|---|---|---|---|---|---|---|---|
| Steel | C | Si | Mn | P | S | Al | Cr | Nb | N | Nb/C*1 | Remarks |
| A | 0.05 | 0.20 | 1.5 | 0.05 | 0.007 | 0.02 | 1.5 | 0.005 | 0.001 | 0.10 | Example of present invention |
| B | 0.05 | 0.20 | 1.5 | 0.05 | 0.007 | 0.02 | 1.5 | 0.003 | 0.002 | 0.06 | Comparative example |
| C | 0.06 | 0.03 | 1.4 | 0.02 | 0.005 | 0.04 | 1.0 | 0.012 | 0.002 | 0.20 | Example of present invention |
| D | 0.06 | 0.03 | 1.4 | 0.02 | 0.005 | 0.04 | 1.0 | 0.005 | 0.002 | 0.08 | Comparative example |
| E | 0.06 | 0.03 | 1.4 | 0.02 | 0.005 | 0.04 | 1.0 | 0.020 | 0.002 | 0.33 | Comparative example |

TABLE 1-continued

| Steel | Chemical composition (mass %) C | Si | Mn | P | S | Al | Cr | Nb | N | Nb/C*1 | Remarks |
|---|---|---|---|---|---|---|---|---|---|---|---|
| F | 0.08 | 0.05 | 1.2 | 0.03 | 0.005 | 0.05 | 0.8 | 0.020 | 0.001 | 0.25 | Example of present invention |
| G | 0.08 | 0.06 | 0.6 | 0.02 | 0.008 | 0.05 | 0.9 | 0.010 | 0.001 | 0.13 | Comparative example |
| H | 0.10 | 0.10 | 1.0 | 0.01 | 0.004 | 0.03 | 1.2 | 0.015 | 0.003 | 0.15 | Example of present invention |
| I | 0.10 | 0.50 | 0.8 | 0.01 | 0.004 | 0.06 | 0.8 | 0.015 | 0.004 | 0.15 | Example of present invention |
| J | 0.10 | 0.10 | 0.8 | 0.01 | 0.004 | 0.06 | 0.4 | 0.015 | 0.003 | 0.15 | Comparative example |
| K | 0.10 | 0.10 | 0.8 | 0.01 | 0.004 | 0.06 | 0.8 | 0.030 | 0.003 | 0.30 | Comparative example |
| L | 0.15 | 0.10 | 1.0 | 0.01 | 0.004 | 0.03 | 1.2 | 0.015 | 0.003 | 0.10 | Comparative example |

*1: Nb and C are respective contents of elements in steel (by mass %).

TABLE 2

| Steel sheet No. | Steel | $Ar_3$ transformation point (° C.)*2 | Manufacturing condition: Heating temperature (° C.) | Finishing temperature (° C.) | Average cooling rate (° C./s) | Coiling temperature (° C./s) | Remarks |
|---|---|---|---|---|---|---|---|
| 1 | A | 780 | 1150 | 840 | 40 | 600 | Example of present invention |
| 2 | A | 780 | 1150 | 740 | 30 | 550 | Comparative example |
| 3 | B | 780 | 1100 | 840 | 40 | 600 | Comparative example |
| 4 | C | 764 | 1200 | 820 | 50 | 550 | Example of present invention |
| 5 | C | 764 | 1200 | 820 | 25 | 650 | Comparative example |
| 6 | C | 764 | 1200 | 820 | 60 | 460 | Comparative example |
| 7 | D | 764 | 1200 | 820 | 50 | 550 | Comparative example |
| 8 | E | 764 | 1200 | 820 | 50 | 550 | Comparative example |
| 9 | F | 776 | 1250 | 840 | 40 | 600 | Example of present invention |
| 10 | F | 776 | 1050 | 780 | 40 | 500 | Comparative example |
| 11 | F | 776 | 1250 | 840 | 30 | 680 | Comparative example |
| 12 | G | 786 | 1250 | 840 | 40 | 600 | Comparative example |
| 13 | H | 751 | 1250 | 820 | 30 | 650 | Example of present invention |
| 14 | I | 791 | 1100 | 800 | 60 | 500 | Example of present invention |
| 15 | J | 778 | 1200 | 820 | 40 | 600 | Comparative example |
| 16 | K | 773 | 1200 | 820 | 40 | 600 | Comparative example |
| 17 | L | 737 | 1200 | 800 | 40 | 600 | Comparative example |
| 18 | A | 780 | 1150 | 900 | 40 | 650 | Comparative example |
| 19 | C | 764 | 1150 | 860 | 60 | 500 | Example of present invention |

*2: The $Ar_3$ transformation point was obtained by approximation from a content of an alloying element by the following formula.

$Ar_3$ (° C.) = 835 − 203 $\sqrt{C}$ + 44.7 Si − 30 Mn + 700 P + 400 Al − 11 Cr

Note that C, Si, Mn, P, Al, and Cr are respective contents of the alloying elements (by mass %).

The hot-rolled steel sheet obtained as described above was descaled by pickling, and then a temper rolling at an elongation rate of 0.5% was performed. Then, specimens were extracted from the steel sheets after the temper rolling and were provided for the following evaluations.

(i) Microstructure Observation

At a one-quarter position in the sheet width direction of the steel sheet after temper rolling, specimens of a cross-section of the sheet thickness parallel to the rolling direction were extracted, polished to obtain mirror surface, and etched with nital. Then, the one-quarter positions in the sheet thickness direction were photographed at appropriate magnifications between 500 to 3000 powers with an optical microscope or a scanning electron microscope. Using the obtained microstructure photographs, a ferrite area ratio (area ratio of the entire ferrite including polygonal ferrite), an area ratio of polygonal ferrite, an area ratio of pearlite to the entire microstructure, and kinds of other microstructures and their area ratios to the entire microstructure were obtained by image analysis to set respective fractions. From the ferrite fraction and the polygonal ferrite fraction obtained as described above, a ratio of the polygonal ferrite in the ferrite ((polygonal ferrite fraction/ferrite fraction)×100(%)) was obtained. The obtained results were listed in Table 3.

TABLE 3

| Steel sheet No. | Microstructure: Ferrite (%)*3 | Polygonal ferrite (%)*4 | Polygonal ferrite ratio (%)*5 | Others (%)*6 | Remarks |
|---|---|---|---|---|---|
| 1 | 90 | 42 | 47 | P: 10 | Example of present invention |
| 2 | 92 | 46 | 50 | P: 8 | Comparative example |
| 3 | 87 | 45 | 52 | P: 13 | Comparative example |
| 4 | 88 | 28 | 32 | P: 12 | Example of present invention |
| 5 | 86 | 46 | 53 | P: 14 | Comparative example |
| 6 | 86 | 0 | 0 | P: 4, B: 10 | Comparative example |
| 7 | 90 | 32 | 36 | P: 10 | Comparative example |
| 8 | 86 | 24 | 28 | P: 14 | Comparative example |
| 9 | 86 | 18 | 21 | P: 14 | Example of present invention |
| 10 | 88 | 47 | 53 | P: 12 | Comparative example |
| 11 | 84 | 65 | 77 | P: 16 | Comparative example |
| 12 | 85 | 42 | 49 | P: 15 | Comparative example |
| 13 | 84 | 32 | 38 | P: 16 | Example of present invention |
| 14 | 82 | 12 | 15 | P: 18 | Example of present invention |

TABLE 3-continued

| Steel sheet No. | Microstructure: Ferrite (%)*3 | Polygonal ferrite (%)*4 | Polygonal ferrite ratio (%)*5 | Others (%)*6 | Remarks |
|---|---|---|---|---|---|
| 15 | 83 | 24 | 29 | P: 17 | Comparative example |
| 16 | 84 | 4 | 5 | P: 16 | Comparative example |
| 17 | 74 | 38 | 51 | P: 26 | Comparative example |
| 18 | 86 | 52 | 60 | P: 14 | Comparative example |
| 19 | 88 | 13 | 15 | P: 11, B: 1 | Example of present invention |

*3: Ferrite fraction (%)

*4: Polygonal ferrite fraction (%)

*5: ((Polygonal ferrite fraction)/(ferrite fraction)) × 100 (%)

*6: Fractions of microstructures other than ferrite P denotes pearlite and B denotes bainite.

(ii) Tensile Test

At the one-quarter position in the sheet width direction of the steel sheet after temper rolling, No. 5 specimens specified by JIS Z 2201 (1998) were extracted such that the tensile test direction became the rolling direction. Subsequently, a tensile test in compliance with the specification of JIS Z 2241 (1998) was conducted on the specimens and a tensile strength (TS) and total elongation (E1) were measured. Thus, strength-elongation balance (TS×E1) was obtained. In this example, a steel sheet whose tensile strength (TS) was 440 MPa or more and strength-elongation balance (TS×E1) was 17 GPa·% or more was evaluated as a steel sheet with high strength and good formability.

(iii) Cross Section Hardness Test

Specimens were extracted from the steel sheets after the temper rolling and Vickers hardness (HVc) at the one-half position in the sheet thickness direction was measured by the method in compliant to JIS Z 2244 (2009).

<Measurement Method>

Test force: 0.98 N

Measurement location: five locations (iv) Soft-Nitriding

Small pieces were extracted from the steel sheets after the temper rolling to perform gas soft-nitriding under conditions described below.

Soft-nitriding atmosphere: gas where ammonia gas is mixed with the same amount of endothermic converted gas Treatment temperature: 570° C.

Treating time: three hours

The small pieces were held at the treatment temperature (570° C.) for the treating time (three hours) and then were oil quenched (oil temperature: 70° C.). Then, the small pieces after oil quenching were provided for the following evaluation.

In compliant to JIS G 0563 (1993), Vickers hardness (HV0.1) at a 0.1 mm-depth position from a sheet surface of the small pieces after the oil quenching was measured. A practical depth of nitrided case compliant to the specification of JIS G 0562 (1993) was also measured. This example evaluated the small piece whose Vickers hardness (HV0.1) was 500 or more and the practical depth of nitrided case was 0.25 mm or more as the small piece with good surface hardening characteristics. By the method similar to (iii), Vickers hardness (HVc') at the one-half position in the sheet thickness direction (non-nitrided portion) was measured. From the Vickers hardness (HVc), which is hardness at the one-half sheet thickness position before the soft-nitriding obtained at (iii), and Vickers hardness (HVc'), which is hardness at the one-half sheet thickness position after the soft-nitriding obtained at (iii), a rate of change in the Vickers hardness at the sheet-thickness center portion between before and after the soft-nitriding: (HVc'−HVc)/HVc×100 (%) was obtained. In this example, the small piece whose absolute value of the rate of change was 5.0% or less was evaluated as having good strength stability (Good) after soft-nitriding and the small piece other than that was evaluated as Poor.

TABLE 4

| Steel sheet No. | Mechanical properties: Tensile strength TS (MPa) | Total elongation El (%) | TS × El (GPa · %) | Hardening characteristics: Hardness of nitrided layer (HV0.1)*7 | Practical depth of nitrided case (mm) | Strength stability: Hardness before nitriding (HVc)*8 | Hardness after nitriding (HVc')*9 | Rate of change of hardness (%)*10 | Evaluation*11 | Remarks |
|---|---|---|---|---|---|---|---|---|---|---|
| 1 | 442 | 40 | 17.7 | 685 | 0.50 | 136 | 130 | −4.6 | Good | Example of present invention |
| 2 | 485 | 29 | 14.1 | 683 | 0.50 | 150 | 141 | −6.1 | Poor | Comparative example |
| 3 | 433 | 40 | 17.3 | 522 | 0.45 | 133 | 122 | −8.6 | Poor | Comparative example |
| 4 | 465 | 38 | 17.7 | 564 | 0.40 | 144 | 139 | −3.3 | Good | Example of present invention |
| 5 | 446 | 41 | 18.3 | 553 | 0.40 | 138 | 128 | −7.0 | Poor | Comparative example |
| 6 | 513 | 31 | 15.9 | 559 | 0.45 | 159 | 136 | −14.6 | Poor | Comparative example |
| 7 | 426 | 42 | 17.9 | 577 | 0.40 | 131 | 123 | −6.2 | Poor | Comparative example |
| 8 | 510 | 35 | 17.9 | 569 | 0.45 | 158 | 149 | −5.9 | Poor | Comparative example |
| 9 | 528 | 34 | 18.0 | 513 | 0.30 | 164 | 161 | −1.9 | Good | Example of present invention |
| 10 | 414 | 43 | 17.8 | 506 | 0.25 | 127 | 117 | −8.1 | Poor | Comparative example |
| 11 | 446 | 40 | 17.8 | 503 | 0.30 | 138 | 129 | −6.3 | Poor | Comparative example |
| 12 | 432 | 41 | 17.7 | 551 | 0.35 | 133 | 127 | −4.6 | Good | Comparative example |
| 13 | 472 | 38 | 17.9 | 600 | 0.45 | 146 | 139 | −4.8 | Good | Example of present invention |
| 14 | 464 | 37 | 17.2 | 518 | 0.35 | 143 | 137 | −4.5 | Good | Example of present invention |
| 15 | 466 | 37 | 17.2 | 400 | 0.15 | 144 | 138 | −4.2 | Good | Comparative example |
| 16 | 548 | 30 | 16.4 | 509 | 0.25 | 171 | 159 | −6.8 | Poor | Comparative example |
| 17 | 490 | 32 | 15.7 | 619 | 0.40 | 152 | 145 | −4.5 | Good | Comparative example |

TABLE 4-continued

| Steel sheet No. | Mechanical properties: Tensile strength TS (MPa) | Total elongation El (%) | TS × El (GPa · %) | Hardening characteristics: Hardness of nitrided layer (HV0.1)*7 | Practical depth of nitrided case (mm) | Strength stability: Hardness before nitriding (HVc)*8 | Hardness after nitriding (HVc')*9 | Rate of change of hardness (%)*10 | Evaluation*11 | Remarks |
|---|---|---|---|---|---|---|---|---|---|---|
| 18 | 421 | 41 | 17.3 | 671 | 0.45 | 130 | 122 | −6.2 | Poor | Comparative example |
| 19 | 488 | 35 | 17.1 | 569 | 0.45 | 151 | 153 | 1.3 | Good | Example of present invention |

*7 : Vickers hardness at a 0.1 mm-depth positon from a steel sheet surface after soft-nitriding
*8: Vickers hardness at a one-half sheet thickness position of a steel sheet before soft-nitriding
*9: Vickers hardness at a one-half sheet thickness position of a steel sheet after soft-nitriding
*10: (HVc'- HVc)/HVc × 100 (%)
*11: An absolute value of a rate of change of hardness of 5.0% or less was evaluated as Good and exceeding 5.0% was evaluated as Poor.

As apparent from Table 4, the examples of the present invention obtained good results in all of strength, formability, and surface hardening characteristics and strength stability after soft-nitriding. On the other hand, the comparative examples whose steel composition and microstructure do not satisfy the preferred conditions of the present invention did not obtain sufficient results in some of the above-described characteristics.

The invention claimed is:

1. A steel sheet for soft-nitriding, having:

a chemical composition containing:

C: 0.05% or more to 0.10% or less;

Si: 0.5% or less;

Mn: 0.7% or more to 1.5% or less;

P: 0.05% or less;

S: 0.01% or less;

Al: 0.01% or more to 0.06% or less;

Cr: 0.5% or more to 1.5% or less;

Nb: 0.005% or more to 0.025% or less; and

N: 0.005% or less, on a mass percent basis, such that C and Nb satisfy the formula $0.10 \leq Nb/C \leq 0.30$, where C and Nb are respective contents of the elements (by mass %), wherein balance comprises Fe and incidental impurities, and a microstructure that is a complex-phase microstructure containing ferrite and pearlite, the microstructure having a ratio of a microstructure other than the ferrite and the pearlite of 1% or less, the microstructure having a ratio of polygonal ferrite in the ferrite of less than 50%.

2. A method for manufacturing a steel sheet for soft-nitriding, including:

heating a steel slab;

performing hot rolling that includes rough rolling and finish rolling; and after the finish rolling, cooling and coiling the steel sheet to produce a hot-rolled steel sheet, wherein the steel slab has a chemical composition containing:

C: 0.05% or more to 0.10% or less;

Si: 0.5% or less;

Mn: 0.7% or more to 1.5% or less;

P: 0.05% or less;

S: 0.01% or less;

Al: 0.01% or more to 0.06% or less;

Cr: 0.5% or more to 1.5% or less;

Nb: 0.005% or more to 0.025% or less; and

N: 0.005% or less, on a mass percent basis, such that C and Nb satisfy the formula $0.10 \leq Nb/C \leq 0.30$, where C and Nb are respective contents of the elements (by mass %), wherein balance comprises Fe and incidental impurities, and setting a heating temperature of the hot rolling from 1100° C. or more to 1300° C. or less, setting a finishing temperature of the finish rolling from an $Ar_3$ transformation point or more to ($Ar_3$ transformation point+100° C.) or less, setting an average cooling rate of the cooling to 30° C./s or more, and setting a coiling temperature of the coiling to 500° C. or more to 650° C. or less.

* * * * *